US010213353B2

(12) United States Patent
Baiera et al.

(10) Patent No.: US 10,213,353 B2
(45) Date of Patent: Feb. 26, 2019

(54) BED STEP STOOL AND METHOD OF USE

(71) Applicant: Vincent J. Baiera, San Diego, CA (US)

(72) Inventors: Vincent J. Baiera, San Diego, CA (US); Michael R. Bowser, Pasadena, CA (US)

( * ) Notice: Subject to any disclaimer, the term of this patent is extended or adjusted under 35 U.S.C. 154(b) by 0 days.

(21) Appl. No.: 16/042,930

(22) Filed: Jul. 23, 2018

(65) Prior Publication Data

US 2018/0325760 A1 Nov. 15, 2018

Related U.S. Application Data

(63) Continuation of application No. 15/175,872, filed on Jun. 7, 2016, now Pat. No. 10,034,807.

(60) Provisional application No. 62/184,102, filed on Jun. 24, 2015.

(51) Int. Cl.

| | |
|---|---|
| ***A61G 7/05*** | (2006.01) |
| ***A47C 12/00*** | (2006.01) |
| ***A61G 7/053*** | (2006.01) |

(52) U.S. Cl.

CPC ..... *A61G 7/053* (2013.01); *A47C 12/00* (2013.01)

(58) Field of Classification Search

CPC ..... A61G 7/053; A61G 2203/36; A47C 12/00
See application file for complete search history.

(56) References Cited

U.S. PATENT DOCUMENTS 2,445,619 A * 7/1948 Josephs ..... A61G 7/053 5/507.1
2,644,961 A * 7/1953 Hillenbrand ..... A61G 7/053 5/507.1
2,659,902 A * 11/1953 Fitzgerald ..... A61G 7/053 182/39
2,941,215 A * 6/1960 Johnson ..... A47C 16/02 5/507.1
3,085,258 A * 4/1963 Wolferts ..... A61H 3/00 135/67
3,162,867 A * 12/1964 Hoffman ..... A61G 7/053 182/91
3,176,322 A * 4/1965 Mulcahy ..... A61G 7/053 297/5
3,668,723 A * 6/1972 Bratton ..... A01N 43/56 297/5

(Continued)

FOREIGN PATENT DOCUMENTS

| | | |
|---|---|---|
| CN | 2624729 | 7/2004 |
| CN | 101666206 | 6/2012 |
| JP | 3191784 U | 7/2014 |

OTHER PUBLICATIONS

International Search Report and Written Opinion for International Patent Application No. PCT/US2016/036998 dated Sep. 12, 2016 in 15 pages.

*Primary Examiner* — Eric J Kurilla
(74) *Attorney, Agent, or Firm* — Procopio Cory Hargreaves and Savitch LLP

(57) ABSTRACT

A bed step stool for assisting a user into and out of bed including opposite sides, a head, and a foot. The bed step stool includes a first support to be disposed closer to the head of the bed; a second support to be disposed closer to the foot of the bed; and a step assembly supported between the first support and the second support, the step assembly to enable the user to step thereon for assisting the user into and out of the bed.

19 Claims, 4 Drawing Sheets

(56) References Cited

U.S. PATENT DOCUMENTS

| | | | | | |
|---|---|---|---|---|---|
| 3,739,793 | A * | 6/1973 | Wilson | A47K 17/026 | 135/67 |
| 4,503,932 | A | 3/1985 | Hilton | | |
| 4,982,464 | A | 1/1991 | Lucero | | |
| 5,046,206 | A * | 9/1991 | Broyles | A47B 83/02 | 108/49 |
| 5,131,494 | A | 7/1992 | Heifetz | | |
| 5,347,666 | A * | 9/1994 | Kippes | A61G 7/10 | 135/67 |
| 5,449,013 | A * | 9/1995 | Landers | A61G 7/053 | 135/67 |
| 5,535,459 | A * | 7/1996 | DiMatteo | A61G 7/001 | 297/DIG. 10 |
| 5,579,864 | A | 12/1996 | Shorrock | | |
| D411,888 | S | 7/1999 | King | | |
| 5,971,102 | A | 10/1999 | Brown | | |
| 6,026,933 | A | 2/2000 | King et al. | | |
| 6,401,280 | B1 * | 6/2002 | Baker | A47C 21/08 | 5/426 |
| 6,871,364 | B1 * | 3/2005 | Leoutsakos | A61G 7/053 | 254/93 HP |
| 7,076,817 | B1 * | 7/2006 | Garver | A61G 7/012 | 425/430 |
| D576,291 | S | 9/2008 | Latimer et al. | | |
| 7,987,538 | B1 | 8/2011 | Kimball | | |
| 8,720,645 | B2 | 5/2014 | Parker | | |
| 2004/0049855 | A1 * | 3/2004 | Leoutsakos | A47C 19/02 | 5/662 |
| 2004/0107519 | A1 * | 6/2004 | Grody | A61G 3/061 | 14/69.5 |
| 2009/0139798 | A1 | 6/2009 | Bernard | | |
| 2009/0294214 | A1 | 12/2009 | Vosbikian et al. | | |
| 2011/0078856 | A1 | 4/2011 | Schulte | | |
| 2013/0111663 | A1 | 5/2013 | Brown | | |
| 2014/0009917 | A1 * | 1/2014 | Westermann | A61G 7/018 | 362/130 |
| 2016/0374881 | A1 * | 12/2016 | Baiera | A47C 12/00 | 5/507.1 |

* cited by examiner

BED STEP STOOL AND METHOD OF USE

CROSS-REFERENCE TO RELATED APPLICATION

This application is a continuation of U.S. patent application Ser. No. 15/175,872 filed Jun. 7, 2016, which claims the benefit of provisional patent application No. 62/184,102 filed on Jun. 24, 2015. Both are incorporated by reference herein.

FIELD OF THE INVENTION

The present subject matter relates generally to a step stool for entry to a bed. More specifically, the present invention relates to a step stool and guardrail that allows users to get into bed from the side of the bed by way rails set at a perpendicular angle to the bed, and doubles as a protective barrier.

BACKGROUND OF THE INVENTION

Seniors and individuals with limited mobility must employ a variety of protective measures when it comes to simple, everyday tasks such as getting in and out of bed and even sleeping. They may use bed rails running parallel to the bed in order to prevent falls, and step stools to help them get in to bed.

A difficulty with bed rails is that they are usually attached to the bed, typically by being placed between the mattress and box spring of the bed. They are not mobile or portable. This makes the user's sleeping situation less flexible.

Additionally, even using a combination of bed rail and step stool, seniors and persons with limited mobility are still required to enter their bed from the top or the bottom (where there are no guardrails). This may inconvenience individuals who must climb up their beds or over their pillows in order to arrive at their desired resting position.

SUMMARY OF THE INVENTION

An aspect of the invention involves a bed step stool for assisting a user into and out of bed including opposite sides, a head, and a foot. The bed step stool includes a first support to be disposed closer to the head of the bed; a second support to be disposed closer to the foot of the bed; and a step assembly supported between the first support and the second support, the step assembly to enable the user to step thereon for assisting the user into and out of the bed.

One or more implementations of the aspect of invention described above includes one or more of the following: the bed includes a height at which the user is supported thereon and the first support includes a guardrail having a height greater than the height of the bed, the guardrail engageable by the user for assisting the user into and out of the bed and forming a barrier to help prevent the user from accidentally rolling off of the bed; the guardrail of the first support includes an upside-down U-shaped tall grab bar; the guardrail is adjustable in height; the second support includes a guardrail having a height shorter than the guardrail of the first support, the guardrail of the second support includes an angled bar; the guardrail of the second support is adjustable in height; a motion-detecting lighting assembly illuminates the step assembly upon detected motion of the user; the first support and the second support define a pathway for entry and exit with respect to the bed that is perpendicular with respect to the sides of the bed whereby the user goes between the first support and the second support to step onto the step assembly; and/or the first support includes a taller guardrail including front and rear legs that define a first plane, the second support includes a shorter guardrail including front and rear legs that define a second plane, and the first plane and the second plane are parallel to each and perpendicular to planes defined by the sides of the bed.

Another aspect of the invention involves a method of using the bed step stool of the aspect of the invention and/or one or more implementations described above to get into bed. The method includes approaching the bed step stool and turning sideways towards the bed and facing forward towards first support; grabbing the first support, stepping onto the step assembly, and turning backside to the bed; while grabbing the first support, sitting down on an edge of the bed; and laying down to a resting position on the bed and lifting one's legs over the second support.

One or more implementations of the aspect of invention described immediately above includes one or more of the following: the bed includes a height at which the user is supported thereon and the first support includes a guardrail having a height greater than the height of the bed, and the method includes engaging the guardrail of the first support for assisting the user into the bed and forming a barrier to help prevent the user from accidentally rolling off of the bed; the second support includes a guardrail having a height shorter than the guardrail of the first support, and lifting one's legs over the second support includes lifting one's legs over the shorter guardrail of the second support; the bed step stool includes a motion-detecting lighting assembly that illuminates the step assembly upon detected motion of the user, and the method includes illuminating the step assembly upon detected motion of the user by the motion-detecting lighting assembly; the first support and the second support define a pathway for entry and exit with respect to the bed that is perpendicular with respect to the sides of the bed, and the method includes passing between the first support and the second support to step onto the step assembly Another aspect of the invention involves a method of using the bed step stool of the aspect of the invention and/or one or more implementations described above to get out of bed. The method includes engaging the first support; using the first support to lift one's shoulders off of the bed, swinging one's legs over the second support, and placing one's feet on the step assembly; sitting up on the bed with one's feet on the step assembly to gain composure; using at least one hand on the first support standing up on the step assembly; and while keeping one's hand on the first support, slowly steps off the step assembly, onto floor.

One or more implementations of the aspect of invention described immediately above includes one or more of the following: the bed includes a height at which the user is supported thereon and the first support includes a guardrail having a height greater than the height of the bed, and the method includes engaging the guardrail of the first support for assisting the user out of the bed; the second support includes a guardrail having a height shorter than the guardrail of the first support, and swinging one's legs over the second support includes swinging one's legs over the shorter guardrail of the second support; the bed step stool includes a motion-detecting lighting assembly that illuminates the step assembly upon detected motion of the user, and the method includes illuminating the step assembly upon detected motion of the user by the motion-detecting lighting assembly;

DETAILED DESCRIPTION OF EMBODIMENTS OF INVENTION

Figure 1:
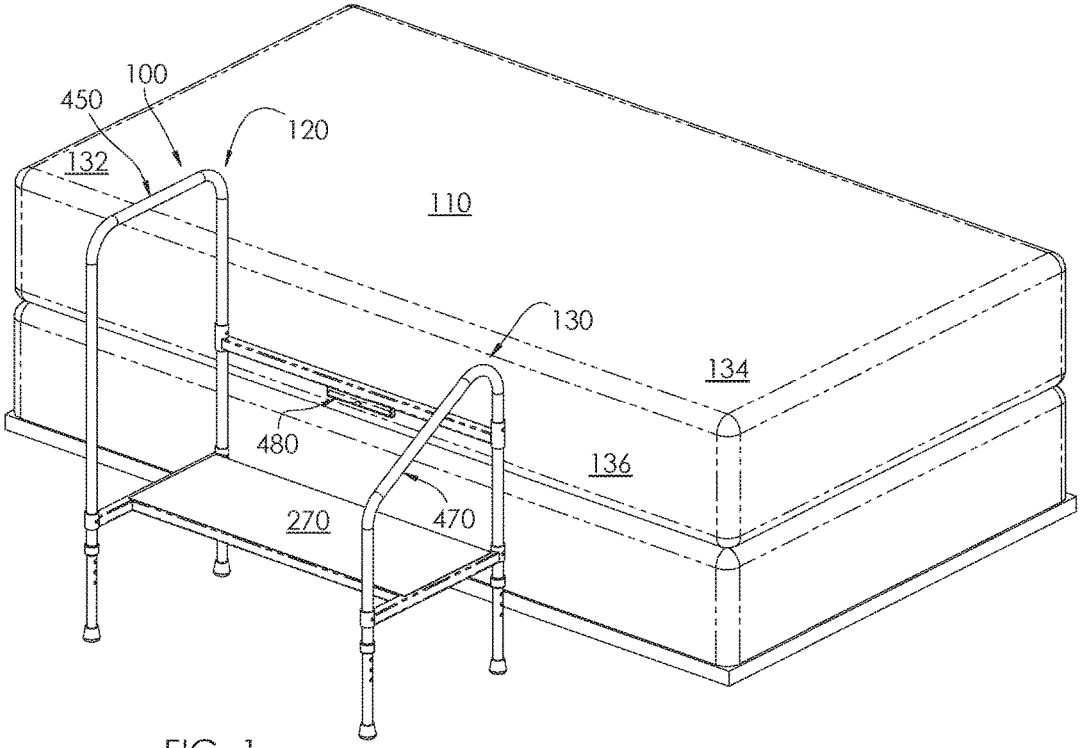
FIG. 1 is a perspective view of an embodiment of the bed step stool shown in position/use adjacent to a side of a user's bed.
Figure 2:
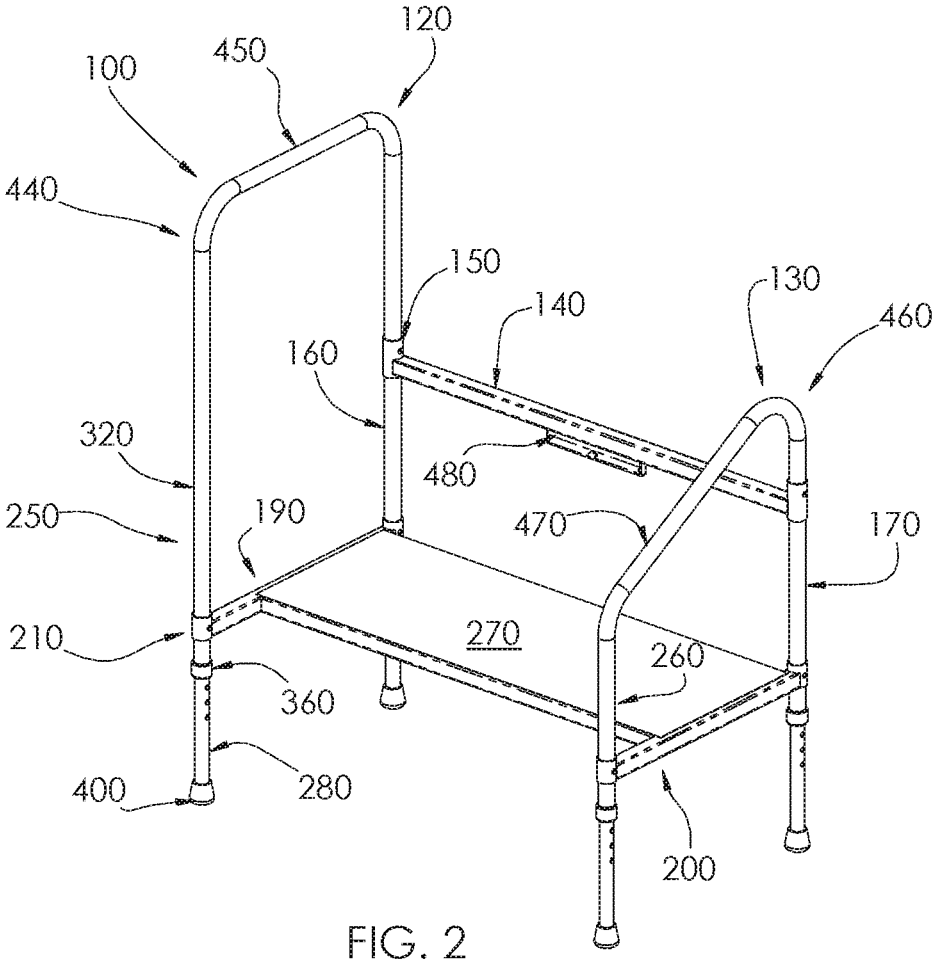
FIG. 2 is a perspective view of the bed step stool of FIG. 1.
Figure 3E:
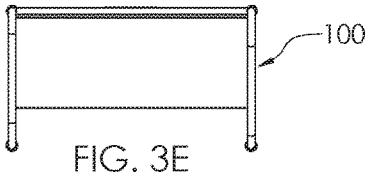
FIGS. 3A, 3B, 3C, 3D, 3E, and 3F are front, rear, right, left, top, and bottom views of the bed step stool of FIG. 1.
Figure 3D:
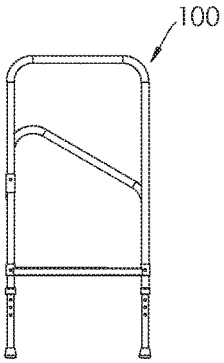
Figure 3A:
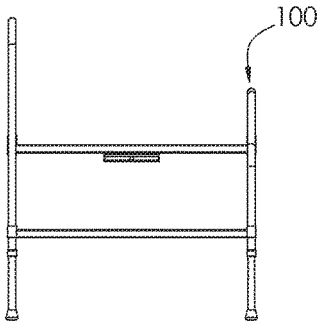
Figure 3C:
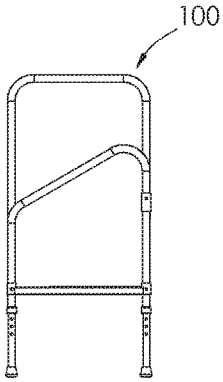
Figure 3B:
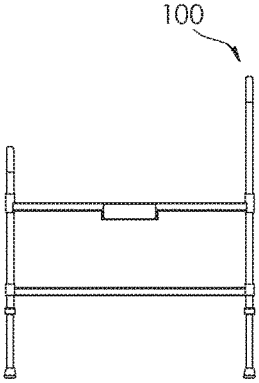
Figure 3F:
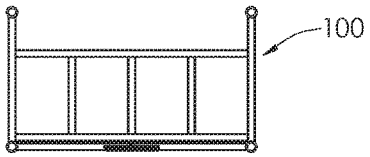

With reference to FIGS. 1 to 3F, an embodiment of a bed step stool 100 for use by a user to assist the user to get into and out of a bed 110 will be described. Although the bed step stool 100 is shown and described as an aid for assisting one to get into and out of a bed, the step stool 100 may be used to assist one onto and off of various types of elevated furniture. For example, but not by way of limitation, the step stool 100 may be used to assist one to get in and out of a vehicle (e.g., car, van) that may be too high for them (e.g., step stool 100 may be a different model/version having a lower cross bar in the back, but still maintain similar functionality to that shown and described herein). The step stool 100 may be used in the home to assist one onto and off of an elevated chair/stool (e.g., bar stool) taller than a kitchen chair.

The bed step stool 100 includes a long(er)/tall(er) guardrail/first support 120 parallel with and spaced with respect to a short(er) guardrail/second support 130. The tall guardrail 120 is closer to a head 132 of the bed and the short guardrail 130 closer to a foot 134 of the bed 110. The tall guardrail 120 is taller than a height of the bed 110 at which the user is supported when resting and the short guardrail 130 is closer in height to the height of the bed 110. The tall guardrail 120 and the short guardrail 130 define respective parallel planes that are perpendicular with a plane define by a side 136 of the bed 110.

A lateral crossbar assembly 140 connects (via fasteners 150) a back leg 160 of the tall guardrail 120 to a back leg 170 of the short guardrail 130.

Step crossbar assemblies 190, 200 connect (via fasteners 210) the back legs 160, 170 to front legs 250, 260 of the tall guardrail 120 and short guardrail 130, respectively.

A step assembly 270 has a generous width and depth to enable a user (e.g., senior) to securely step onto the step assembly 270. The step assembly 270 may include a slip protection tape or another slip prevention material on an upper surface. The step assembly 270 is supported between the tall guardrail 120 and the short guardrail 130 by the step crossbar assemblies 190, 200.

The longitudinal direction of the lateral crossbar assembly 140 and the step assembly 270 are parallel with the plane define by a side 136 of the bed 110 and perpendicular with respect to planes defined by the tall guardrail 120 and the short guardrail 130. When the bed step stool 100 is in position, with the crossbar assembly 140 adjacent to or abutting the side 136 of the bed 110, the bed step stool 100 and the bed 110 form a T-shaped configuration.

The tall guardrail 120 and short guardrail 130 include elevation tubes/legs 280 telescopingly received in upper tubes 320, 33, 340, 350 for adjusting the height of the entire bed step stool 100 and the height of the step assembly 270 via rotatable adjustment collars 360 and bolt holes/bolts.

The step height is what goes up or down based off the bolt hole you choose (the height) that works for you. The tall and short rail's height relationship doesn't change after It's put together, only the step height and the unit as a whole then keeps the same relationship of distance.

Lower ends of the elevation tubes 280 include rubber tips 400.

An upper portion 440 of the tall guardrail 120 includes an upside-down U-shaped tall grab bar 450.

An upper portion 460 of the short guardrail 130 includes an angled/inclined bar 470.

The lateral crossbar assembly 140 carries a motion-detecting lighting assembly 480 for illuminating via one or more lights (e.g., LEDs) the step assembly 270 upon detected motion (e.g., movement of the user's legs) of the user by a motion sensor.

In an alternative embodiment, the bed step stool 100 includes a configuration for use with the opposite side of the bed 110. In this alternative embodiment, instead of the tall guardrail 120 on the left side and the short guardrail 130 on the right side of the step assembly 270, the tall guardrail 120 is on the right side and the short guardrail 130 on the left side of the step assembly 270. The upper portions 440, 460 of the tall guardrail 120 and the short guardrail 130 (or, alternatively, the tall guardrail 120 and the short guardrail 130) are reversible to enable the bed step stool 100 to accommodate both sides of the bed 110.

Although the bed step stool 100 shown may accommodate a wide variety of different-sized users, in an alternative embodiment, the bed step stool 100 includes one or more configurations to accommodate different types/sized users.

Figure 4A:
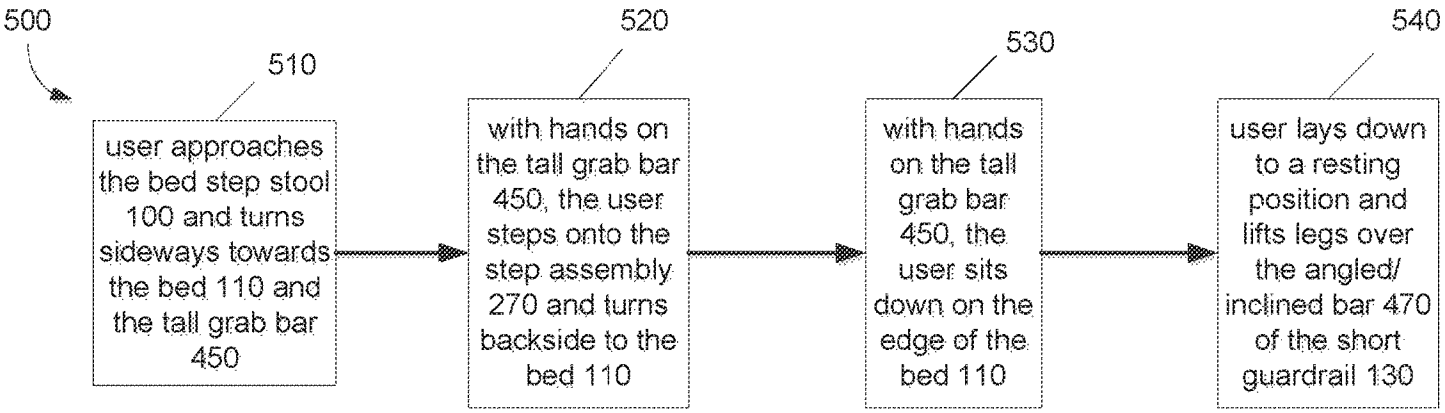
FIG. 4A is a flow chart illustrating an exemplary method of using the bed step stool to get into the bed shown in FIG. 1.

With reference additionally to FIG. 4A, an exemplary method 500 of using the bed step stool 100 to get into the bed 110 will be described. At step 510, the user approaches the bed step stool 100 and turns sideways towards the bed 110 and the tall grab bar 450 (i.e., user facing towards tall grab bar 450 and the head 132 of the bed 110). As the user approaches the bed step stool 100, the motion-detecting lighting assembly 460 illuminates the step assembly 270 upon detected movement of the user's legs. At step 520, with hands on the tall grab bar 450, the user steps onto the step assembly 270 and turns backside to the bed 110. At step 530, with hands on the tall grab bar 450, the user sits down on the edge of the bed 110. At step 540, the user lays down to a resting position and lifts one's legs over the angled/inclined bar 470 of the short guardrail 130.

Figure 4B:
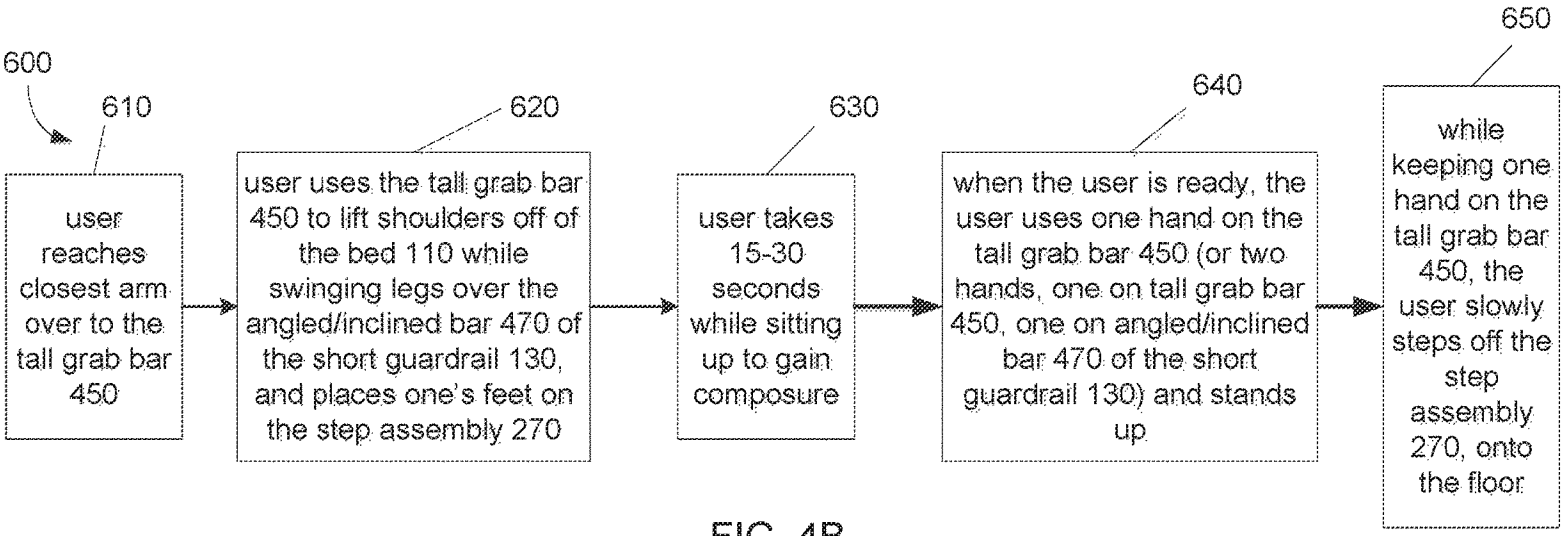
FIG. 4B is a flow chart illustrating an exemplary method of using the bed step stool to get out of the bed shown in FIG. 1.

With reference additionally to FIG. 4B, an exemplary method 600 of using the bed step stool 100 to get out of the bed 110 will be described. At step 610, a user reaches one's closest arm over to the tall grab bar 450. At step 620, the user uses the tall grab bar 450 to lift one's shoulders off of the bed 110 while swinging legs over the angled/inclined bar 470 of the short guardrail 130, and places one's feet on the step assembly 270. As the user swings one's legs over the angled/inclined bar 470 and one's feet approach the step assembly 270, the motion-detecting lighting assembly 460 illuminates the step assembly 270 upon detected movement of the user's legs. At step 630, the user takes 15-30 seconds while sitting up to gain composure. At step 640, when the user is ready, the user uses one hand on the tall grab bar 450 (or two hands, one on tall grab bar 450, one on angled/inclined bar 470 of the short guardrail 130) and stands up.

At step 650, while keeping one hand on the tall grab bar 450, the user slowly steps off the step assembly 270, onto the floor.

Advantages of the bed step stool 100 and above described methods include one or more of the following: the perpendicular orientation of the tall guardrail 120 and the short guardrail 130 with respect to of the bed step stool 100 provides a pathway to entry/exit with respect to the bed 110 whereby the user goes between the guardrails 120, 130 to step on the step assembly 270, the bed step stool 100 allows individuals to safely enter/exit their bed 110 from the side 136 of the bed 110, the bed step stool 100 provides guardrails 120, 130 for support and protection at a perpendicular angle to the longitudinal direction of the bed 110 (or plane define by the side 136 of the bed 110), allowing the user to safely remain secure in the bed 110, the elevation tubes/legs 280 telescopingly received in upper tubes 320, 33, 340, 350 allow the user to adjust the height of the bed step stool 100 so that the bed step stool 100 can be used with a variety of bed heights and/or user heights, the bed step stool 100 allows users to enter the bed 110 at the final point of resting and eliminates the need to move the bed 110 up or down into position, the step assembly 270 of the bed step stool 100 includes a wide platform to improve safety and ease of use, the bed step stool 100 may be used in any setting, including a nursing home, a hospital, or a patient's home; the bed step stool 100 may be used with different types of beds/furniture; because the bed step stool 100 rests on legs rather than between the mattress and the box spring, there is no limit to the type of furniture/beds that the bed step stool 100 can be used in connection with, the bed step stool 100 is portable (the bed step stool 100 in the embodiment shown and described is designed not to attach to the bed, allowing one to easily store the bed step stool 100 by sliding it into a corner or closet when not in use); the bed step stool 100 helps reduce a senior's risk of falling because as they use the product their actual fear of falling is reduced; and/or the bed step stool 100 provides the user with a sense of safety (using the step 270 and grab bar(s) 450, 470 make the user more confident in one's movements; when the user feels safer, the user reduces the risk of falling by reducing one's fear of falling).

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. A bed step stool for assisting a user into and out of bed including opposite sides, a head, and a foot, comprising:

a first support to be disposed closer to the head of the bed;

a second support to be disposed closer to the foot of the bed;

a step assembly supported between the first support and the second support, the step assembly to enable the user to step thereon for assisting the user into and out of the bed, wherein the first support and the second support define an unobstructed pathway for entry and exit with respect to the bed and the bed step stool that is perpendicular with respect to the sides of the bed whereby the user goes between the first support and the second support to step onto the step assembly and off the step assembly without any obstruction.

2. The bed step stool of claim 1, wherein the bed includes a height at which the user is supported thereon and the first support includes a guardrail having a height greater than the height of the bed, the guardrail engageable by the user for assisting the user into and out of the bed and forming a barrier to help prevent the user from accidentally rolling off of the bed.

3. The bed step stool of claim 2, wherein the guardrail of the first support includes an upside-down U-shaped tall grab bar.

4. The bed step stool of claim 2, wherein the guardrail is adjustable in height.

5. The bed step stool of claim 2, wherein the second support includes a guardrail having a height shorter than the guardrail of the first support.

6. The bed step stool of claim 5, wherein the guardrail of the second support includes an angled bar.

7. The bed step stool of claim 5, wherein the guardrail of the second support is adjustable in height.

8. The bed step stool of claim 1, further including a motion-detecting lighting assembly that illuminates the step assembly upon detected motion of the user.

9. A bed step stool for assisting a user into and out of bed including opposite sides, a head, and a foot, comprising:

a first support to be disposed closer to the head of the bed;

a second support to be disposed closer to the foot of the bed;

a step assembly supported between the first support and the second support, the step assembly to enable the user to step thereon for assisting the user into and out of the bed, wherein the first support includes a taller guardrail including front and rear legs that define a first plane, the second support includes a shorter guardrail including front and rear legs that define a second plane, and the first plane and the second plane are parallel to each and perpendicular to planes defined by the sides of the bed.

10. A bed step stool for assisting a user into and out of bed including opposite sides, a head, and a foot, comprising:

a first support to be disposed closer to the head of the bed;

a second support to be disposed closer to the foot of the bed;

a step assembly supported between the first support and the second support, the step assembly to enable the user to step thereon for assisting the user into and out of the bed, wherein the bed includes opposite sides that define respective planes, a head, and a foot, the first support to be disposed closer to the head of the bed and defining a first plane; the second support, which is shorter than the first support, to be disposed closer to the foot of the bed and defining a second plane, the first plane and the second plane being parallel to each and perpendicular to the planes defined by the sides of the bed.

11. The bed step stool of claim 1, wherein step assembly includes a single-step step assembly.

12. The bed step stool of claim 1, wherein the step assembly extends a distance in a direction parallel to the bed and extends a distance in a direction perpendicular to the bed that is less than the distance the step assembly extends parallel to the bed.

13. The bed step stool of claim 10, wherein the guardrail of the first support includes an upside-down U-shaped tall grab bar.

14. The bed step stool of claim 10, wherein the guardrail is adjustable in height.

15. The bed step stool of claim 10, wherein the guardrail of the second support includes an angled bar.

16. The bed step stool of claim 10, wherein the guardrail of the second support is adjustable in height.

17. The bed step stool of claim 10, further including a motion-detecting lighting assembly that illuminates the step assembly upon detected motion of the user.

18. The bed step stool of claim 10, wherein step assembly includes a single-step step assembly.

19. The bed step stool of claim 10, wherein the step assembly extends a distance in a direction parallel to the bed and extends a distance in a direction perpendicular to the bed that is less than the distance the step assembly extends parallel to the bed.

* * * * *